US005975846A

United States Patent [19]

Wistinghausen

[11] Patent Number: 5,975,846

[45] Date of Patent: Nov. 2, 1999

[54] PUMP FOR WASHING-MACHINES, TUMBLE-DRIERS, DISHWASHERS AND SUCHLIKE

[75] Inventor: Walter Wistinghausen, Detmold, Germany

[73] Assignee: Hanning Elektro-Werke GmbH & Co., Oerlinghausen, Germany

[21] Appl. No.: 09/005,643

[22] Filed: Jan. 12, 1998

[30] Foreign Application Priority Data

Feb. 10, 1997 [DE] Germany ..... 297 02 253 U

[51] Int. Cl.[6] ..... D06F 39/08

[52] U.S. Cl. ..... 415/206; 68/208; 134/186

[58] Field of Search ..... 415/203, 206, 415/212.1; 68/208; 134/186

*Primary Examiner*—John E. Ryznic
*Attorney, Agent, or Firm*—Richard M. Goldberg

[57] ABSTRACT

A pump for washing-machines, tumble-driers, dishwashers and the like includes an inlet into which an inlet pipe enters, an outlet which is connected to an outlet pipe, with the inlet pipe being disposed and shaped in such a way that a least one low point is formed in the inlet pipe, at which an entire cross-section of the inlet pipe is lower than the inlet of the pump.

3 Claims, 2 Drawing Sheets

PUMP FOR WASHING-MACHINES, TUMBLE-DRIERS, DISHWASHERS AND SUCHLIKE

BACKGROUND OF THE INVENTION

The invention relates to a pump for washing-machines, tumble-driers, dishwashers and suchlike, with an inlet into which an inlet pipe enters, and an outlet which is connected to an outlet pipe.

Household appliances of the said type have a drum that can be closed by a lid or a door, usually made from plastic or sheet metal, out of which used washing or rinsing water has to be pumped away after every work cycle. Pumps are used for this purpose; they are built into the housing of the machine and are connected to said drum on the inlet side, whilst on the outlet side, they are connected to a hose that proceeds from the housing.

Noise is generated as the water is sucked out of the drum, especially towards the end of the pumping procedure when an ever greater volume of air is sucked out as well. Furthermore, the metal sheet or plastic walls of the drum generally act as a kind of sound board, which amplifies the sucking noise even more. These sucking noises are generally regarded as an unpleasant disturbance.

SUMMARY OF THE INVENTION

The invention is therefore based on the task of creating a pump of the above-mentioned type, whose inlet pipe is disposed and shaped in such a way that at least one low point is formed in the inlet pipe, at which the whole cross-section of the inlet pipe is lower than the inlet of the pump.

By sloping the inlet pipe down to a low point upstream of the pump, one ensures that there will always be water in this portion of the inlet pipe. This water completely, or at least to a large degree, prevents the suction noise of the pump from being communicated back into the drum, where it is amplified.

The low point in the inlet pipe can be realized in many different ways. It can, for example, be designed as a U-shaped section of pipe, as used to lock in odours in wastewater disposal pipes in kitchens and bathrooms. A U-shaped flow path can also be created by means of upper and lower partitions in a straight section of pipe.

In the prior art solutions the inlet pipe usually enters the pump housing horizontally. With this disposition, one particularly simple solution to the task according to the invention is to arrange the pump housing at such a slope that the inlet pipe, seen from the upstream direction, slopes downwards and only goes on to form an upwardly directed curve further upstream.

BRIEF DESCRIPTION OF THE DRAWINGS

Preferred embodiments of the invention will be described in more detail below with reference to the following drawings, in which.

DETAILED DESCRIPTION

Figure 1:
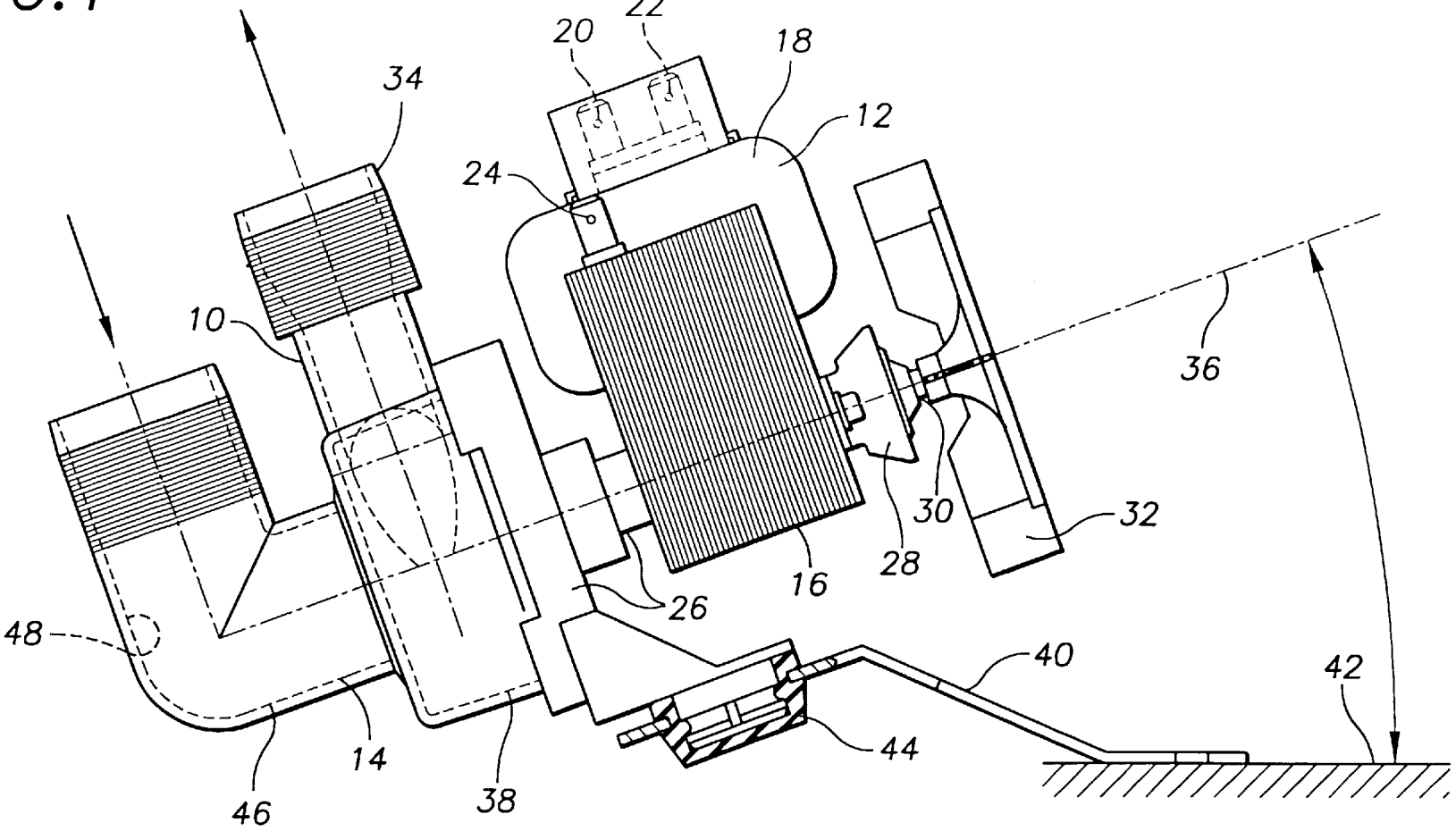
FIG. 1 is a side view of a pump according to the invention with associated drive motor, and also shows an inlet pipe and an outlet pipe connected to the pump.

FIG. 1 shows a diagrammatic view of a connected arrangement consisting of a pump 10, a drive motor 12 and an inlet pipe or inlet 14 for the pump. The drive motor 12 is an electric motor with a stator packet 16 and a coil 18. On the coil 18 there are two connecting terminals for supplying electricity to the drive motor 12. A test terminal is designated by 24.

The drive motor 12 has a front end shield 26 and a back end shield 28. Proceeding out of the back end shield 28 there is a drive shaft 30, which supports a fan propeller 32 for cooling down the drive motor.

The drive shaft 30 extends through the front end shield 26 into the pump 10 and is mounted in the front end shield 26 and sealed off with a shaft seal. End shield 26 also creates a connection between the drive motor 12 and the pump 10. The overall construction of the motor is already known, and therefore does not require any further explanation.

The pump 10 draws in water from the left in FIG. 1 in its axial direction and expels it in the radial direction. Hence FIG. 1 shows an inlet pipe 14 entering from the left and an outlet pipe 34 that exits in an upwards direction. Pumps of this construction, which are usually referred to as centrifugal pumps, are simple and robust so that they can be used in preference for said type of applications.

In pumps of this sort, the inlet pipe 14 enters the pump housing, which is designated by 38, in the direction of the common axis 36. The drive motor 12 and pump 10 are usually disposed in a machine so that the axis 36 lies horizontally. FIG. 1, however, shows that in this embodiment of the invention, the arrangement comprising the drive motor 12 and pump 10 is disposed such that the axis 36 slopes upwards towards the right in FIG. 1. This means that the inlet pipe 14, starting from the pump 10, slopes downwards in the upstream direction. The angle of inclination of axis 36 is around 20° in this example, but depends essentially on the geometry and the dimensions of inlet pipe 14.

To conform to the inclination of axis 36, the arrangement comprising pump 10 and drive motor 12 is held in place inside the machine housing by means of a correspondingly bent arm 40. The machine housing is not shown in its entirety in FIG. 1, but is represented by a surface 42, which is, for example, the base of the housing. The arm 40 is connected with the front end shield 26 via a rubber element 44. The rubber element serves to stop the housing from being exposed to the vibrations caused by the rotating pump wheel and electromagnetic interaction between the stator and the rotor.

As can also been seen from FIG. 1, the inlet pipe 14 consists of a section 46 that slopes downwards to the left in FIG. 1, and an upwardly directed section 48 that follows on from section 46 forming a 90° curve with it. During the washing and rinsing procedures the pump housing 38, the inlet pipe 14 and the outlet pipe 34 are completely filled with water or suds. If the pump 10 is started up, a volume flow imposes itself within a very short time. When the associated drum is almost drained, an increasing volume of air is also sucked in by the pump. The greater the volume of air, the more the volume flow comes to a standstill. Once there is a certain volume of air in the pump housing, a pump of this construction is no longer able to pump water.

This is because the pump wheel operates solely on the basis of centrifugal force, and because the pump cannot build up any underpressure worth mentioning on the suction side. But if the pump wheel is only partially submerged in water, the paddles of the rotating pump wheel cause perceptible noises in the developing water-air mixture similar to cavitation noises, whose sound waves can spread beyond the inlet pipe into the connected washing drum if this path is not at least partially blocked by water.

By inclining the axis 36 of the pump and by contriving a bend in the inlet pipe 14 as per FIG. 1, one can ensure that even after the drum has been drained, an appreciable volume of water remains in the inlet pipe 14 and the pump housing 38, which the pump wheel is no longer capable of pumping, and which forms a certain sound-proofing between the pump and the drum.

Figure 2:
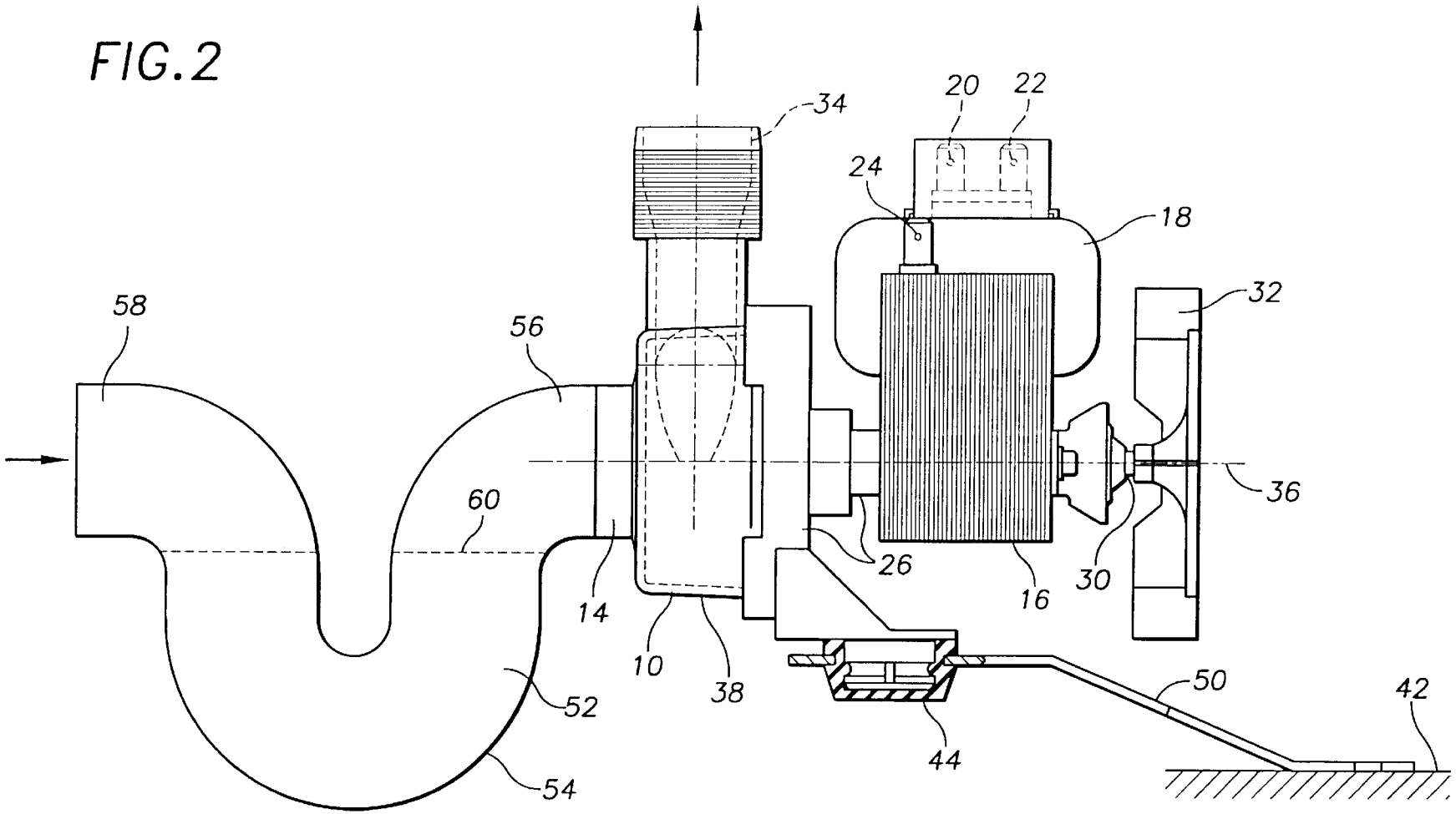
FIG. 2 shows a second embodiment of the invention, represented in a similar way as in FIG. 1.

The embodiment of FIG. 2 essentially corresponds to that of FIG. 1 and so identical reference numerals are used for the same parts and, in particular, explanations will only be given where there are deviations from the first embodiment.

According to FIG. 2, there is an arm 50 between the base 42 and the rubber element 44, which is formed in such a way that the axis 36 of pump 10 and drive motor 12 lie horizontally. Accordingly, the inlet pipe 14 also enters the pump housing 38 horizontally.

To interrupt the acoustic connection between the pump 10 and the drum (not shown), which is located upstream of the inlet pipe 14 there is in this case an intermediate element 52 which is connected with the pump 10 on the one hand, and with the hose or pipe connection leading to the drum (not shown) on the other hand. Just like an odour lock-in mechanism, the intermediate element comprises a U-shaped, downwardly directed curve 54 which connects two aligned connecting sections 56 and 58 on both sides of the curve. In the curve 54, the water-level will settle at approximately the height indicated by line 60 so that the direct air-air connection between the pump and the drum being drained is interrupted, thereby preventing noise from being communicated.

The embodiment of FIG. 2 permits numerous other modifications providing other ways of creating a low point at which the acoustic connection between the pump and the drum is completely or at least partially interrupted, even at the end of the pumping procedure.

Insofar as the inlet pipe and the outlet pipe are described as 'pipes' it should be noted that the term 'pipes' can, in this context, also include flexible hosing, at least in part. In practice plastic socket pieces are usually attached to the pump and the drum whilst hoses form the other part of the pipe connections.

What is claimed is:

1. A pump for washing-machines, tumble-driers, dishwashers with an inlet into which an intermediate element having a U-shaped section enters, and an outlet which is connected to an outlet pipe, the intermediate element being disposed and shaped in such a way that at least one low point is formed in the intermediate element, at which an entire cross-section of the intermediate element is lower than the inlet of the pump.

2. A pump for washing-machines, tumble-driers, dishwashers with an inlet into which an intermediate element enters, and an outlet which is connected to an outlet pipe, the intermediate element being disposed and shaped in such a way that at least one low point is formed in the intermediate element, at which an entire cross-section of the intermediate element is lower than the inlet of the pump, and said intermediate element comprises a downwardly running, U-shaped curve and two aligned connecting sections on both sides of the curve.

3. A pump for washing-machines, tumble-driers, dishwashers with an inlet into which an inlet pipe enters, and an outlet which is connected to an outlet pipe, the inlet Pipe being disposed and shaped in such a way that at least one low point is formed in the inlet pipe, at which an entire cross-section of the inlet pipe is lower than the inlet of the pump, the pump being a centrifugal pump that takes in water axially along a pump axis and expels it radially, with a pump housing and a pump wheel that rotates in the latter, and in which pump the inlet pipe enters the pump housing along a geometric axis of the pump, the pump housing being disposed in such a way that the pump axis is sloped, and the inlet pipe slopes downwards in an upstream direction and then goes on to form an upwardly directed curve.

* * * * *